United States Patent [19]

Duhl

[11] 4,285,216

[45] Aug. 25, 1981

[54] SINGLE BAR, WARP LIFT-OFF-RESISTANT, LOFTED FABRIC CONSTRUCTION

[75] Inventor: Daniel Duhl, New York, N.Y.

[73] Assignee: Polylok Corporation, New York, N.Y.

[21] Appl. No.: 33,181

[22] Filed: Apr. 26, 1979

[51] Int. Cl.[3] ..... D04B 23/08; D04B 23/10

[52] U.S. Cl. ..... 66/192; 66/193; 66/202

[58] Field of Search ..... 66/85 A, 85, 84 A, 190–195, 66/202; 428/290

[56] References Cited

U.S. PATENT DOCUMENTS

| | | | |
|---|---|---|---|
| 3,231,533 | 6/1966 | Garrett et al. | 428/290 X |
| 3,279,221 | 10/1966 | Gliksmann | 66/192 |
| 3,475,200 | 10/1969 | Kallert et al. | 428/290 X |
| 3,567,565 | 3/1971 | Jones et al. | 66/202 |
| 3,649,428 | 3/1972 | Hughes | 66/192 |
| 3,664,157 | 5/1972 | Koclita et al. | 66/192 |
| 3,669,792 | 6/1972 | Mitsukawa et al. | 428/290 X |
| 3,672,187 | 6/1972 | Simpson | 66/192 |
| 3,713,868 | 1/1973 | Gordon et al. | 428/290 X |
| 3,714,078 | 1/1973 | Gordon et al. | 428/290 X |
| 3,992,904 | 11/1976 | Webb et al. | 66/190 |
| 4,144,727 | 3/1979 | Duhl et al. | 66/202 |

FOREIGN PATENT DOCUMENTS

| | | | |
|---|---|---|---|
| 1585047 | 11/1969 | Fed. Rep. of Germany | 66/190 |

OTHER PUBLICATIONS

Linton, George E., "The Modern Textile Dictionary", New York, Duell et al., 1954, p. 399.

Bahlo, K. W., "New Fabrics Without Weaving", Modern Textiles Magazine, Nov. 1965, pp. 51–54.

*Primary Examiner*—Ronald Feldbaum

*Attorney, Agent, or Firm*—Pennie & Edmonds

[57] ABSTRACT

A fabric having a novel warp lift-off-resistant construction is made on a stitch-through type machine equipped with a single knitting thread guide bar and comprises a flexible substrate such as a layer of textile yarn filling elements, a plurality of warp elements laid on the substrate in the longitudinal or warpwise direction, and knitting thread forming a multiplicity of warpwise stitches in a warp lift-off-resistant configuration. The knitting thread warp lift-off-resistant configuration comprises, in one embodiment, a combination of at least one half-tricot stitch course and one or more consecutive chain stitch courses on a given knitting thread wale to bind together into an integrated structure the substrate and warp elements, to secure the substrate and warp elements against relative displacement, and to stabilize the fabric against running or lifting off of the warp elements from the fabric surface. As a result of the knitting thread warp lift-off-resistant configuration, the fabric exhibits an aesthetically pleasing appearance corresponding to the loft imparted to the warp elements by virtue of the non-binding of the warpe lements by the chain stitch components of the knitting thread network.

15 Claims, 14 Drawing Figures

SINGLE BAR, WARP LIFT-OFF-RESISTANT, LOFTED FABRIC CONSTRUCTION

DESCRIPTION

1. Technical Field

This invention relates to non-woven fabrics. More particularly, it relates to non-woven composite fabrics of novel functional and aesthetic design which are produced on stitch-through type machines and which are useful, among other things, in decorative applications such as draperies and bedspreads.

2. Background Art

Stitch-through fabrics typically comprise a layer of substantially parallel warp elements or ends on a flexible substrate such as a layer of substantially parallel textile yarn filling elements or ends. The warp elements are affixed to the flexible substrate by laying them on top of the substrate and joining both components into an integrated fabric structure by means of relatively fine knitting or sewing threads. In cases where a more or less open mesh fabric is desired, this can be achieved by controlling the spacing between the individual warp elements and, where the flexible substrate is a layer of textile yarn filling elements, by controlling also the spacing between the individual filling elements. This and other "stitch-through" type fabric structures can be obtained on various machines, including those of the "Malimo" type, using methods and equipment described in U.S. Pat. No. 2,890,579; U.S. Pat. No. 3,030,786; U.S. Pat. No. Re. 25,749; U.S. Pat. No. 3,253,426; U.S. Pat. No. 3,274,806; U.S. Pat. No. 3,279,221; U.S. Pat. No. 3,309,900; U.S. Pat. No. 3,389,583; U.S. Pat. No. 3,392,078; U.S. Pat. No. 3,440,840; U.S. Pat. No. 3,452,561; U.S. Pat. No. 3,457,738; U.S. Pat. No. 3,460,599; U.S. Pat. No. 3,540,238; U.S. Pat. No. 3,541,812; U.S. Pat. No. 3,567,565; and U.S. Pat. No. 3,592,025.

The ability to readily mass-produce a basic fabric in a variety of designs and patterns is extremely important to the commercial success of the fabric. While stitch-through fabrics can be produced at relatively high speed compared to woven fabrics, much attention has been given to augmenting this desirable feature with design flexibility, e.g., with respect to the nature, density, gauge, and color of the fabric components, the spacing between them, and the purposeful omission of a component or the addition of other components.

However, a need has existed for stitch-through fabrics of still further design flexibility, not only with respect to the creation of unusual visual effects but also with respect to achieving new and useful functional features. For example, in prior commercial Malimo fabrics having warp elements, the latter are secured to the substrate by the sewing or knitting thread network in a half-tricot stitch configuration. Such a network inherently causes the warp elements to lie flat against the substrate with no possibility for creating a "loft" or "blooming" effect in the warp component which would be a highly desirable way of simulating the appearance of depth, as for example, in relatively expensive hand-woven fabrics. Also, the nature of the conventional half-tricot stitch configuration of the knitting thread network is such that the warp elements are inherently susceptible to destructive runs or lifting off from the fabric surface due to "unzippering" or unravelling of the knitting thread network beginning at the cut end of the fabric. In the past, this drawback in Malimo fabrics could be dealt with only by a separate and, therefore, time consuming and costly securement operation performed on the cut ends of greige goods subsequent to doffing and each time the fabric is cut during converting and finishing.

Accordingly, it is an object of the present invention to provide a novel decorative fabric concept using stitch-through type machines.

Another object is to provide novel decorative fabrics using stitch-through type machines wherein the warp elements of the fabric exhibit a lofted and/or bloomed appearance.

Yet another object is to provide novel decorative fabrics using stitch-through type machines wherein the warp elements have a substantially increased resistance to running or being lifted off the fabric due to unzippering or unravelling of the sewing or knitting thread network.

These and other objects of the invention as well as a fuller understanding of the advantages thereof can be had by reference to the following detailed description, drawings and claims.

DISCLOSURE OF THE INVENTION

The foregoing objects are achieved according to the present invention by a novel fabric concept utilizing at least one needle guide bar on a stitch-through type machine such as, but not limited to a Malimo machine. Such a fabric comprises a flexible substrate, a plurality of warp elements laid on the substrate in the warpwise or machine (i.e., longitudinal) direction, and knitting or sewing threads in parallel warpwise wales across the width of the fabric and forming, in one type of embodiment, a multiplicity of loop stitches in a configuration having a combination of chain stitch courses and half-tricot stitch courses on a given knitting thread wale. The knitting thread thus forms a warp lift-off-resistant network which binds together into an integrated fabric structure the substrate and warp elements and secures the substrate and warp elements against relative displacement.

The term "warp lift-off-resistant" as used herein is understood to mean a characteristic of the present fabric structure in which the warp elements have a substantially increased resistance to running or being lifted off the fabric due to unzippering or unravelling of the sewing or knitting-thread network. Such warp lift-off-resistance is the result of a knitting thread configuration which affords increased resistance to running of the warp elements by virtue of the fact that such elements pass over some of the courses of the knitting thread network.

Due to the fact that the warp elements are confined and held down against the flexible substrate only by the half-tricot stitch courses or portions of the knitting thread wales and not by the chain stitch courses or regions, the fabrics of the invention possess an aesthetically pleasing appearance corresponding to the loft or "loose look" imparted to the lofted warp element segments by the non-binding or relaxation effect of the chain stitch courses or components of the warp lift-off-resistant knitting thread configuration. In addition, it has been discovered that this unique configuration of the knitting thread network effectively stabilizes the fabric, in a manner not heretofore possible, against destructive unzippering or unravelling of the knitting thread network and resultant running or lifting off of the warp elements from the fabric surface, particularly at the cut ends of the fabric where such unravelling and runs are most likely to begin.

In one embodiment of the fabric of the present invention, the warp lift-off-resistant knitting thread configuration comprises, on a given knitting thread wale, at least one half-tricot stitch followed by one or more chain stitches, with generally from 3 to 32 loops or courses per linear inch as measured in the warpwise direction and generally from 3 to 22 parallel knitting thread wales per linear inch as measured in the weftwise direction. Desirably, the fabric has from 6 to 16 and preferably from 6 to 12 knitting thread courses per inch and from 4 to 18, and preferably from 7 to 10 knitting thread wales per inch. In the preferred case of a fabric having from 6 to 12 courses per inch and from 7 to 10 wales per inch, the knitting thread sequence will preferably have at least three consecutive chain stitch courses followed by one or more half-tricot stitch courses.

It is a feature of the present invention that the knitting thread warp lift-off-resistant configuration stabilizes the fabric to an extent not heretofore possible by virtue of the discovery that on a given knitting thread wale, the chain stitches "lock" the tricot stitches down on the body of the fabric so that any unravelling or unzippering which develops in the half-tricot stitch portion of the wale are arrested at the half-tricot stitch/chain stitch juncture. In this way, when a warp element is pulled or subjected to a displacement force, say, at the cut end of the fabric, any running or "lifting off" of the warp element from the surface of the fabric can only commence in and proceed through the first half-tricot stitch region of a knitting thread wale. As soon as the unravelment encounters the juncture or intersection of the first chain stitch portion with the following half-tricot stitch portion of the wale, the run is effectively halted.

Another unique and totally unexpected feature of the present fabric construction is the fact that, as the ratio of the number of chain stitch courses to the number of half-tricot stitch courses increases per unit length along a given wale (having a given number of courses per unit length) the loft or "loose look" of the fabric increases while the strength of the fabric, i.e., the resistance of the warp elements to running or lifting off, also increases. In addition, such stability of the warp elements increases with increasing number of courses per unit length along the wale.

The warp elements suitable for use in the present invention can be any of those elements heretofore used in stitch-through fabric construction. Of particular preference are yarns, such as multifilament figure yarns, multifilament low twist crimped yarns, taslanized (air-entangled) yarns, spiral yarns consisting of low twist spun yarns combined with a fine binder yarn; and/or ribbons, such as fabric or felted ribbons because of their ability to exhibit optimum unfettered loft or bloom in those regions where the elements are free of the confining effect of the knitting thread. When employed in the present fabric construction, the warp elements can be laid on the flexible substrate component in either mutually contacting relationship or can be spaced apart from one another in the weftwise direction at any predetermined distance. In one embodiment of the invention, the warp elements are substantially spaced apart in order to amplify and enhance the visual effect of the "home spun" or "open-weave look" characteristic of fabrics produced in stitch-through type machines. In addition, the warp elements can be laid on the flexible substrate in a substantially rectilinear or straight line fashion parallel to the warpwise direction. Alternatively, as described in U.S. Pat. No. 3,672,187, the warp or "design" elements (so called because of the aesthetically pleasing appearance and ornamental effect which they impart to the fabric) can be caused to follow non-rectilinear paths along the warpwise direction, and/or in a twisted configuration in the manner disclosed in U.S. Pat. No. 4,144,727, which disclosures are incorporated herein by reference.

The flexible substrate upon which the warp elements are laid in forming the fabric of the present invention can be a pre-knitted (e.g., tricot) or pre-woven fabric; fibrous batting, or any other continuous sheeting; one or more layers of textile filling elements running in a general weftwise direction with respect to the warp elements, or any other flexible structure capable of being secured to the warp elements with knitting thread according to procedures described in U.S. Pat. No. 3,672,187 and now familiar to those skilled in the art of stitch-through fabric construction. In the case of fabrics having the open-mesh "home spun" appearance characteristic of casement or drapery fabrics, a flexible substrate in the form of at least one layer of more or less spaced-apart textile filling yarns or elements is preferred.

The knitting thread used to bind together into an integrated textile fabric structure the warp elements and flexible substrate can be any thread heretofore used in stitch-through fabric construction and is applied to the fabric components by means of the mechanical stitching elements conventionally employed, for example, on Malimo-type stitch-through machines. These elements and their mode of operation are well known to those skilled in the art and include a comb-like sinker bar and comb-like retainer pin bar, which together define an elongated space or work zone for fabric formation between them. The stitching elements include additionally a row of pronged or bearded pointed needles and corresponding closing wires the combination of which is caused to move in a reciprocating fashion through the aforesaid work zone in coaction with a row of knitting thread guides for forming a multiplicity of warp-wise knitting thread loop chains. In the operation of the machine, alternate loops in the half-tricot stitch portion of each chain are formed with a different knitting thread. Loop chains of the type characteristic of the half-tricot stitch configuration are preferred for use in combination with chain stitches when the fabric includes warp elements laid in rectilinear (straight line) fashion in the warpwise direction because of the normally greater structural integrity imparted to the overall fabric by the half-tricot stitch component of the knitting thread network. In such cases the fabric components are engaged and held together by the loops of knitting thread courses on the rear side of the fabric and by the laps of the knitting thread courses on the front surface by which, in the half-tricot stitch regions, the diagonal segment or laps formed by the knitting thread secures the warp to the substrate. In this way the warp elements are "lapped" by the sewing thread around the substrate (e.g., textile yarn filling elements) to achieve an integrated fabric structure. In those regions of the knitting thread network which are made up of chain stitches, such stitches are formed of a single knitting thread end which defines a single wale of the thread network.

In one embodiment of the fabric of the invention, at least two warp elements can be laid on the substrate along non-rectilinear paths in the warpwise direction thereby creating a design effect which serves to augment the aesthetically pleasing appearance of the fabric. More particularly, such warp "design elements" can include portions of substantial length extending diagonally, relative to the warpwise direction, along straight lines or curving substantially uniformly. The warp elements can be disposed in groups composed of at least two adjacent elements following a substantially identical pattern. Alternatively, adjacent warp elements can be laid on the flexible substrate to form different patterns, e.g., wherein they form the same pattern but one is reversed relative to the other. This fabric design feature and an apparatus and method for achieving it, which can be practiced in conjunction with the present invention, are described respectively in U.S. Pat. No. 3,672,187, particularly at column 1, line 31 through column 3, line 44, and U.S. Pat. No. 3,677,034, particularly at column 1, line 44 through column 8, line 22, which disclosures are incorporated herein by reference.

In another embodiment of the invention, which can, if desired, be employed in combination with the embodiment described in the preceding paragraph, a further aesthetically pleasing appearance can be obtained by varying a plurality of adjacent warp elements in their relative level positions along the length of the fabric by twisting them at spaced intervals along the warp direction in the manner disclosed in the aforementioned U.S. Pat. No. 4,144,727. In particular, the adjacent warp elements which are twisted at spaced intervals along the warpwise direction of the fabric can be laid on the substrate in the intervals between twists in either mutually contacting relationship or can be spaced apart from one another in the weftwise direction at any predetermined distance. Desirably, such warp elements are substantially spaced apart in order to amplify the visual effect of the twist by contrast. The degree of "twist" imparted to the warp elements can be any angular amount from greater than 0° C. to 360° although a degree of twist of desirably at least 90° and preferably 180° is preferred in order to maximize the visual effect created by the twist configuration, and to achieve a true twisting or crossing over of the warp elements as opposed to apparent twisting brought about by proximation of the warp elements without an actual crossing over of such elements, which apparent twisting obtains when the degree of twist is less than 90°. In the case of a 180° twist, opposite warp elements in a group of two or more are caused to exchange places with each other and then return to their original relative positions along the fabric with each alternate twist. In the regions or intervals between the twists, the elements can be laid on the flexible substrate in a substantially rectilinear or straight line fashion parallel to the warpwise directions; alternatively, as described hereinabove, the warp elements can be caused to follow non-rectilinear paths in conjunction with their twisted configuration.

In still another embodiment of the invention, the fabric further comprises a flexible self-liner material disposed beneath the flexible substrate (which in turn is laid beneath the warp elements) in the manner disclosed in applicant's copending and commonly assigned U.S. patent application Ser. No. 003,361 filed Jan. 15, 1979, the disclosure of which is incorporated herein by reference. The knitting thread network having the aforementioned warp lift-off-resistant configuration, whose loops appear on the rear surface of the lining material, likewise binds together into an integrated self-lined textile fabric structure the lining material, the flexible substrate, and the warp elements and secures said components against relative displacement. The fabric of this embodiment achieves a further combination of functional utility and decorative visual effect of aesthetically pleasing appearance through the unique placement of the functional lining of flexible material which is disposed behind or beneath the flexible substrate (e.g., of textile filling elements) and the textile warp elements. In this way, the lining material performs its function (e.g., thermal acoustic or optical insulation) without interfering with the unity of warp and filling or obstructing the effect of the intermediate substrate layer (e.g., of filling yarn elements) and the outer layer of warp yarn elements. Such self-lined fabric construction provides practical as well as aesthetically useful composite fabrics in which the lining material performs a definite function (e.g., thermal insulation) either per se or through various post-treatments (e.g., resin back-coating which also provides a convenient way of achieving a "blackout" effect when desired) without interfering with the decorative function of the remaining components of the fabric which are positioned in front of the lining or backing component.

The flexible lining or backing material component of the foregoing embodiment is preferably a layer of fibrous non-woven, pre-knitted (e.g., tricot) or pre-woven fabric. The use of such lining materials is particularly advantageous because of the ease with which, say, an applied fibrous non-woven lining can be subsequently back-coated with a thin layer of polymer, e.g., acrylic or urethane foam, to impart effective thermal insulating or barrier properties while retaining the desired casement-like "feel" and "look" of the composite fabric as a whole. Alternatively, the lining can be any other flexible material capable of being stitched-through by knitting thread and secured thereby to the overlying substrate (e.g., filling yarns) and warp elements. Such other lining materials include, without limitation, synthetic polymeric compositions such as foamed polyurethane, polymeric film, and fibrous batting, e.g., continuous filament batting, and these can also be given a polymeric back-coating, if desired. Examples of embodiments of the invention include fabrics in which the self-liner is a continuous sheet material in the form of randomly arranged highly dispersed continuous filaments, e.g., spun-bonded continuous filament polyester sold by E. I. du Pont de Nemours & Co. under the trademark "Reemay", and entangled staple fiber, e.g., spun-laced polyester staple sold by du Pont under the trademark "Sontara". As indicated above, these liners can be back-coated with polymeric compositions. Other materials suitable for use as the self-liner of the fabric of the present invention will be apparent to those skilled in the art upon appreciation of the present disclosure. In the case where the substrate is other than a layer of textile filling yarns, e.g., continuous sheet material, a fabric is obtained which in effect has two linings.

The self-lined fabric embodiment of the invention can also be heat-bonded in pattern design to another fabric by use of Pinsonic-type quilting, the details of the application of which to the fabric of this invention will be apparent to those skilled in the art and having the benefit of the present disclosure before them. The self-lined fabric of such embodiment can be either foamed or unfoamed. In this manner, the back of the fabric will be quilted while the face side is unquilted.

The fabrics produced in the manner of the present invention employing knitting thread to bind the warp elements and the flexible substrate into an integrated structure have the feature in which the knitting thread pierces the individual warp elements and pierces the flexible substrate (in the case of filling yarns) at a substantial number of random points to further secure the substrate and warp elements against relative displacement.

In its broad aspect, the fabrics of the present invention can be produced on a stitch-through machine, e.g., a Malimo-type stitch-through machine, by the steps of (a) delivering a flexible substrate to the above-described work zone of the stitch-through type machine and (b) delivering to the work zone conjointly with and in superimposed relation to the substrate a plurality of warp elements. The superimposed warp elements and flexible substrate are bound together at the work zone of the machine by the warpwise knitting thread network to form an integrated structure which is the fabric of the present invention in greige form, and which is ready for further processing to finished fabric according to art-recognized procedures, e.g., dyeing, drying, resinating, etc.

The particular aspect of the foregoing procedure which makes possible the formation of the present novel fabric construction is the use of at least one and preferably a single knitting thread needle guide bar which can be programmed, in a manner which will be apparent to those skilled in the art and having the benefit of the present disclosure of the invention before them, to deliver the knitting threads of each wale to the stitching elements in one or more of the above-described stitching sequences. In one embodiment the guide bar shaft of a Malimo machine which carries the stitching yarn guides is disconnected from the horizontal motion eccentric and its horizontal motion is derived from and controlled by a pattern chain similar to those used on tricot or raschel warp knitting machines for control of their yarn guides. The said pattern chain could be driven from the main Malimo machine shaft or other shaft by gears, sprockets or timing belts. In this way, it is possible to produce the present fabrics at a rate of speed comparable to that at which conventional stitch-through fabrics are produced having the normal half-tricot stitch knitting thread configuration throughout. In addition, the use of at least one and preferably a single knitting thread needle bar to lay the wales of knitting thread results in a fabric in which the lofted and unlofted portions of the warp yarn elements extend in parallel bands transversely across the fabric, i.e., in the weftwise direction, thereby imparting a unique secondary pattern to the "loose look" of the fabric.

BRIEF DESCRIPTION OF THE DRAWING

Further details of the present invention and the advantages thereof can be had by reference to the accompanying drawings wherein.

DESCRIPTION OF THE PREFERRED EMBODIMENTS

In the following description, the corresponding elements as shown in each figure of the drawings are given the same reference number, and letter suffixes are added to designate specific ones of these elements where necessary.

Figure 1:
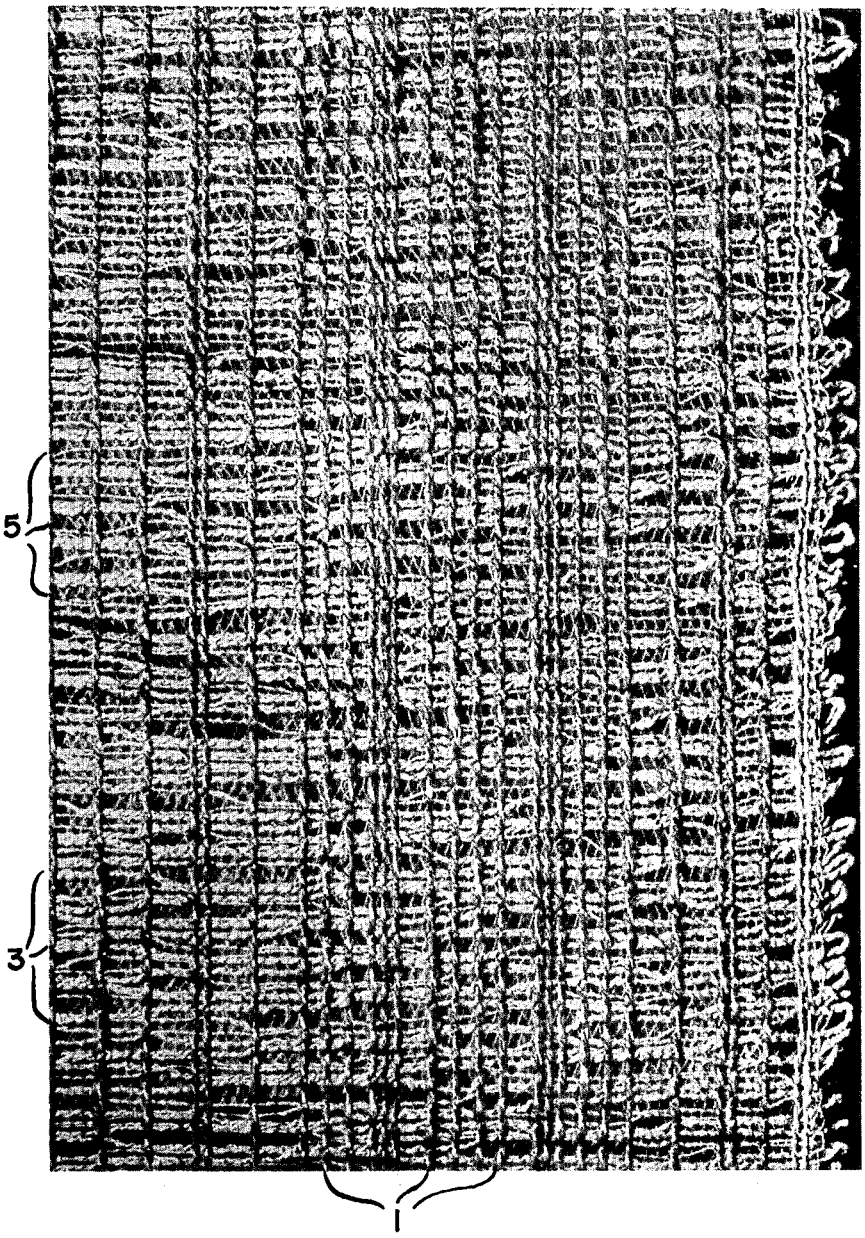
FIG. 1 is a plan view of the front surface of a prior art fabric of conventional structure with respect to the disposition of the warp elements on the flexible substrate.

Referring to FIG. 1, there is shown a conventional stitch-through fabric composed of warp yarn elements 1, textile yarn filling elements 3, and knitting thread 5 applied in a half-tricot stitch configuration network throughout. Of particular interest is the appearance of the warp yarn elements 1 which are uniformly secured to the flexible substrate of textile filling elements 3 by virtue of the half-tricot stitch configuration of the knitting thread network. As a result, the fabric lacks the three-dimensional appearance of the fabrics of the present invention since the warp yarn elements are prevented from lofting or blooming by the uniformly lapping or binding effect of the half-tricot stitches of the knitting thread.

Figure 2:
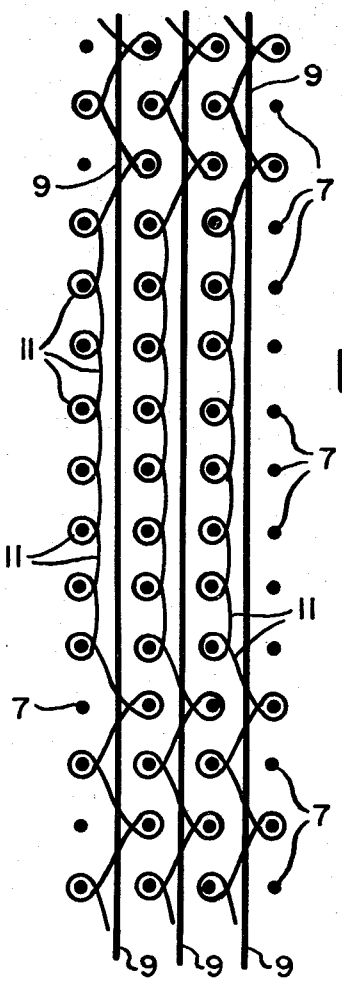
FIG. 2 is a schematic representation of the movement of the knitting-needle guide bar for producing a segment of a stitch-through fabric of the invention.

Referring to FIG. 2, the horizontal and vertical rows of equally spaced dots 7 represent the knitting needles of the stitch-through machine, and the vertical solid lines 9 represent the placement of the warp elements relative to the knitting thread 11. Each horizontal row of dots can be visualized as the plan of the needle bar, each dot representing one needle head. The bottom row of points indicates the needle bar at the first course, the second row indicates the needle bar at the second course, and so on. Thus each vertical column of dots represents the same needles at successive courses, or alternatively, can be taken to represent one wale in the fabric. Since all the knitting thread guides on the single bar are rigidly mounted therein, they all make exactly the same movements at each course, as can be seen in FIG. 2, which depicts the formation of a knitting thread warp lift-off-resistant configuration comprising eight consecutive chain stitch courses followed by three consecutive half-tricot stitch courses.

Figure 3A:
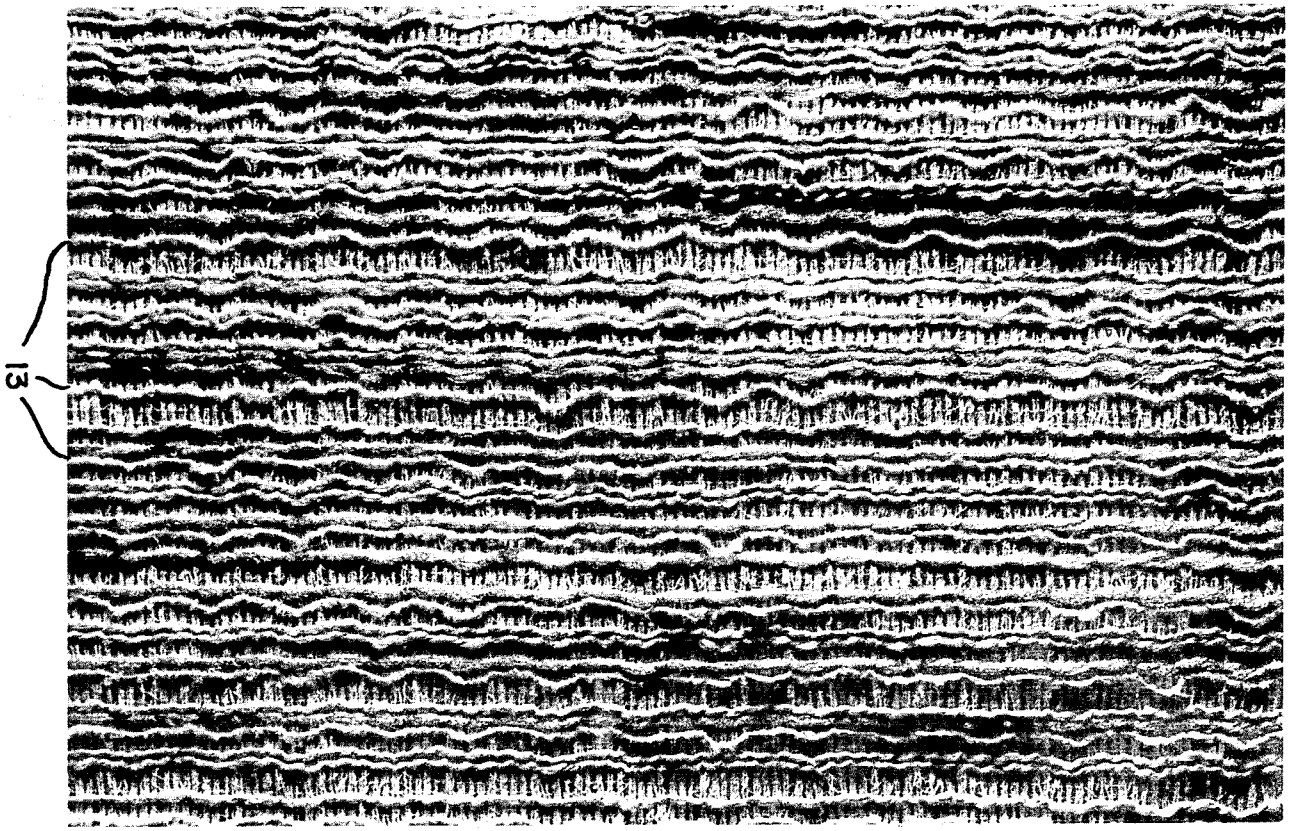
FIG. 3A is a plan view of the front surface of a first embodiment of the fabric of the invention.
Figure 3B:
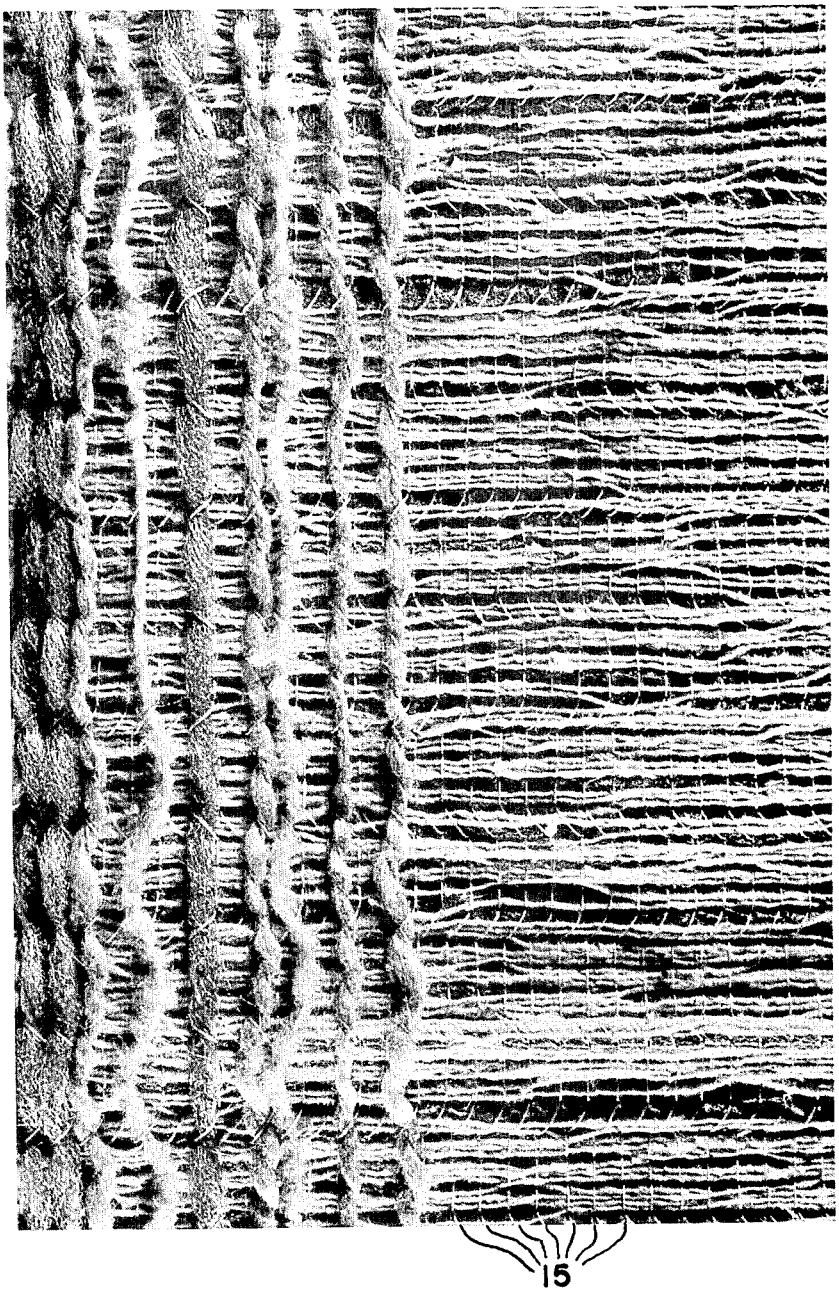
FIG. 3B is an enlarged front view of a portion of the fabric of FIG. 3A showing the relationship between the elements thereof.
Figure 3C:
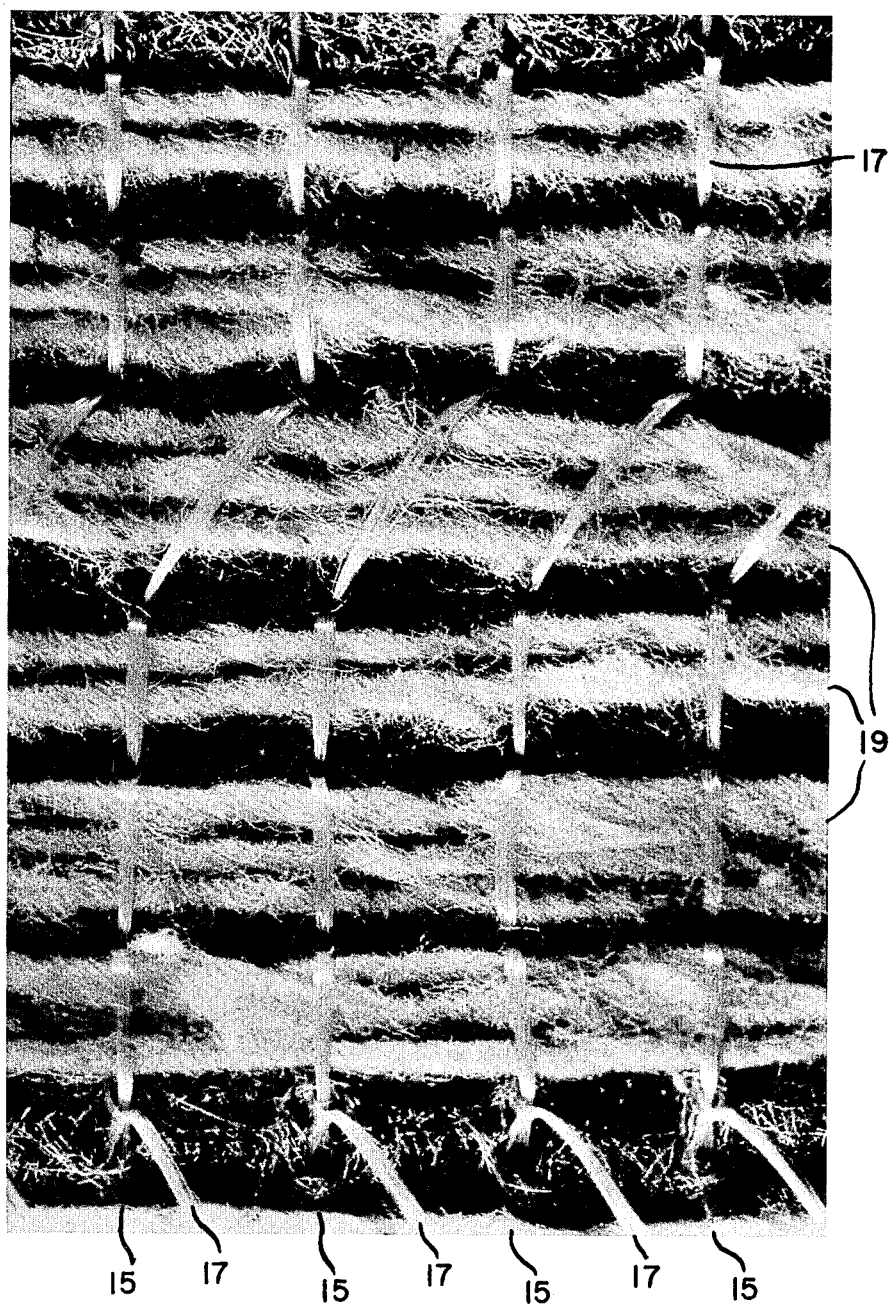
FIG. 3C is a further enlarged front view of a portion of the fabric of FIG. 3A showing the relationship between the flexible substrate and knitting thread.

Referring to FIG. 3A, which is a plan view of the front surface of a first embodiment of the fabric construction of the invention, the warp elements 13 impart a three-dimensional effect or appearance of depth to the fabric by virtue of the loft created in those lengths where the warp elements pass over the chain stitch segment of each knitting thread wale 15 of the 3-chain/1-half-tricot stitch configuration as depicted in FIG. 3B. FIG. 3C shows in detail the aforementioned configuration of the knitting threads 17 in relation to the textile yarn filling elements 19.

Figure 3D:
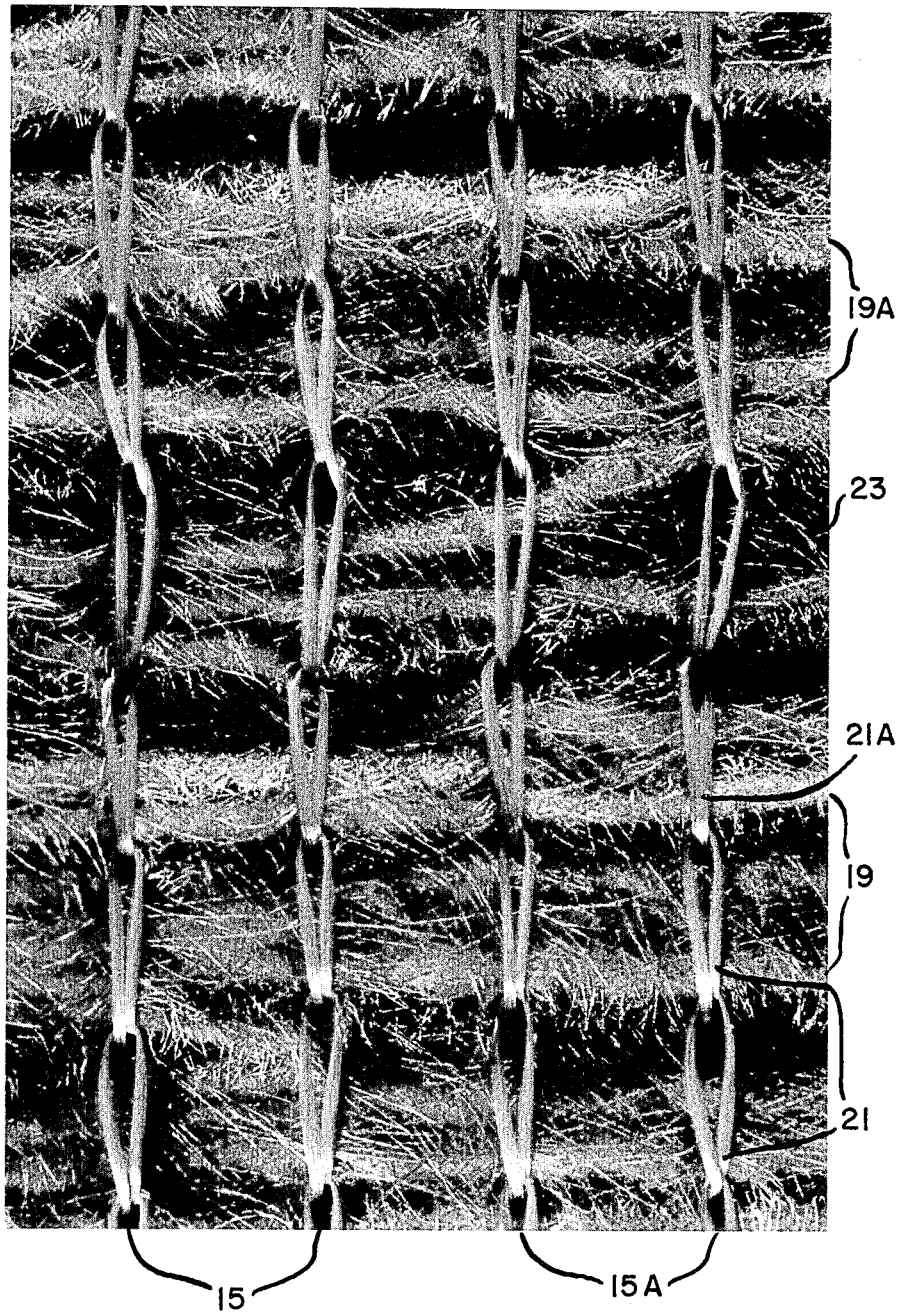
FIG. 3D is an enlarged plan view of the rear surface of a portion of the fabric of FIG. 3A.

Referring to FIG. 3D, the loops 21 of the knitting thread courses of each wale 15 on the rear side of the fabric of FIG. 3A can be readily seen. These loops bind the non-woven fibrous batting 23 of the self-liner to the textile filling yarn substrate 19 and to the warp elements (not shown).

Figure 4A:
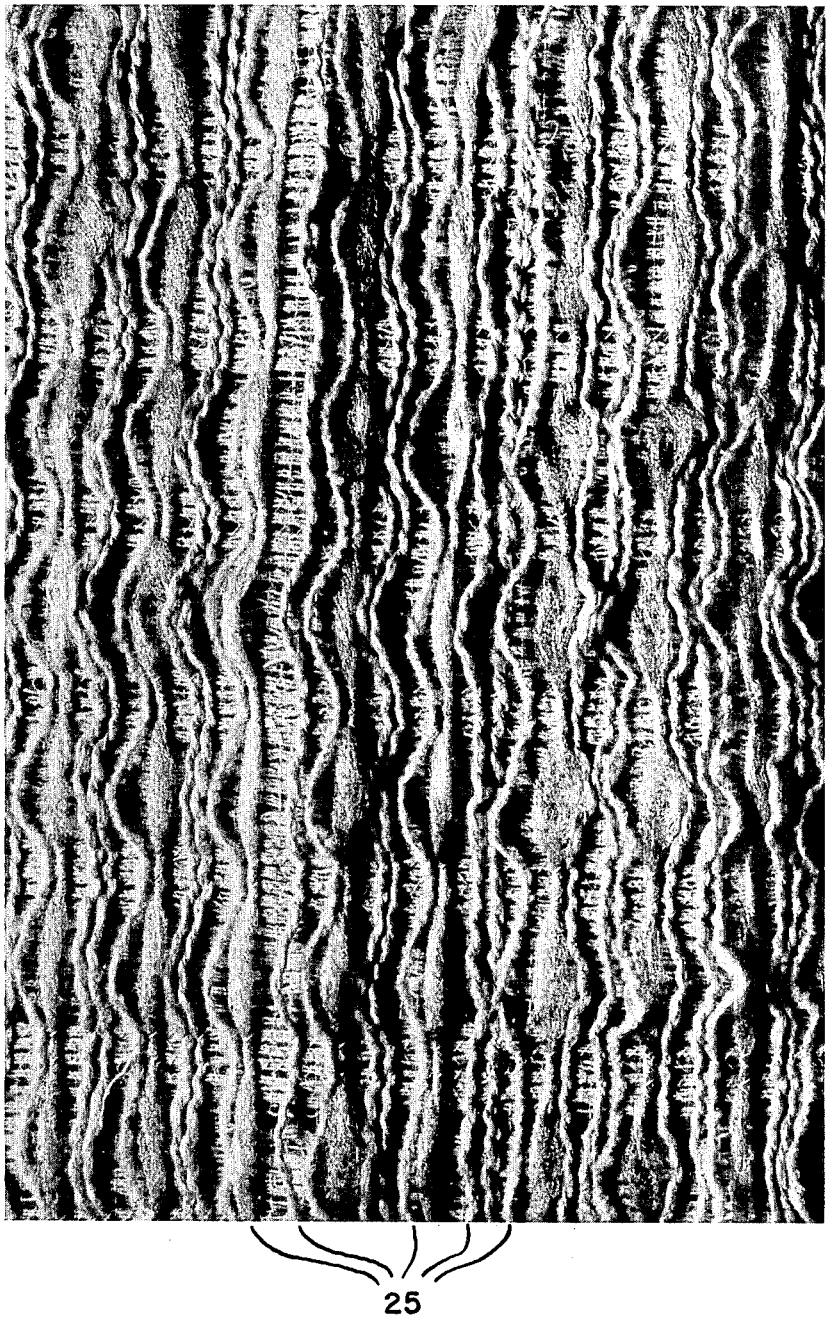
FIG. 4A is a plan view of the front surface of a second embodiment of the fabric of the invention.
Figure 4B:
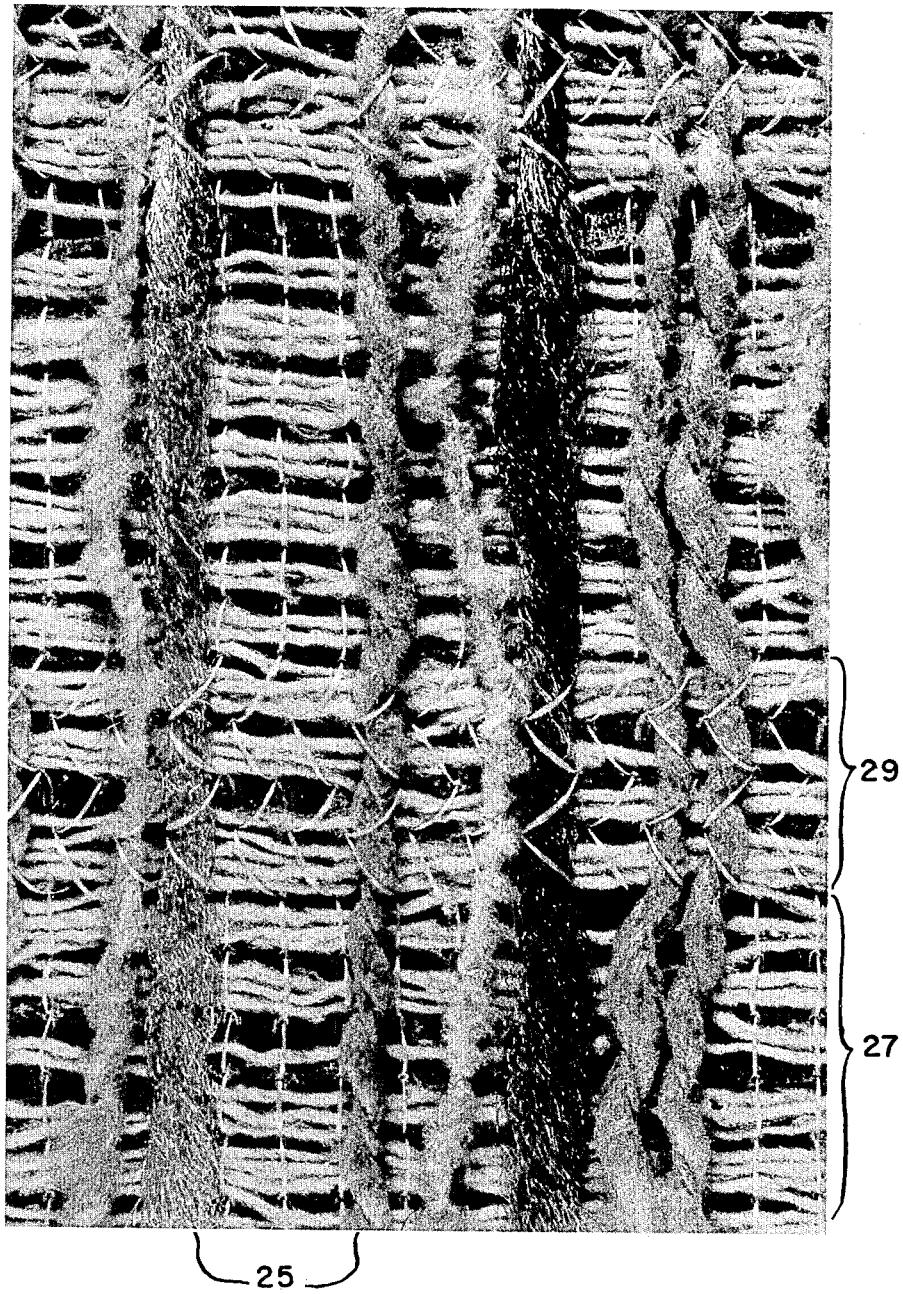
FIG. 4B is an enlarged front view of a portion of the fabric of FIG. 4A showing the relationship between the elements thereof.

Referring to FIG. 4A, which is a plan view of the front surface of a second embodiment of the fabric construction of the invention, the lofting of the warp elements 25 can be seen over the chain stitch portion of the 8-chain/4-half-tricot stitch knitting thread network shown in greater detail to FIG. 4B. Since the number of chain stitches 27 to half-tricot stitches 29 is greater in the fabric of FIG. 4A than in the fabric of FIG. 3A (both fabrics having the same number of knitting thread courses per unit length), the loft imparted to the warp elements of the former is correspondingly greater.

Figure 4C:
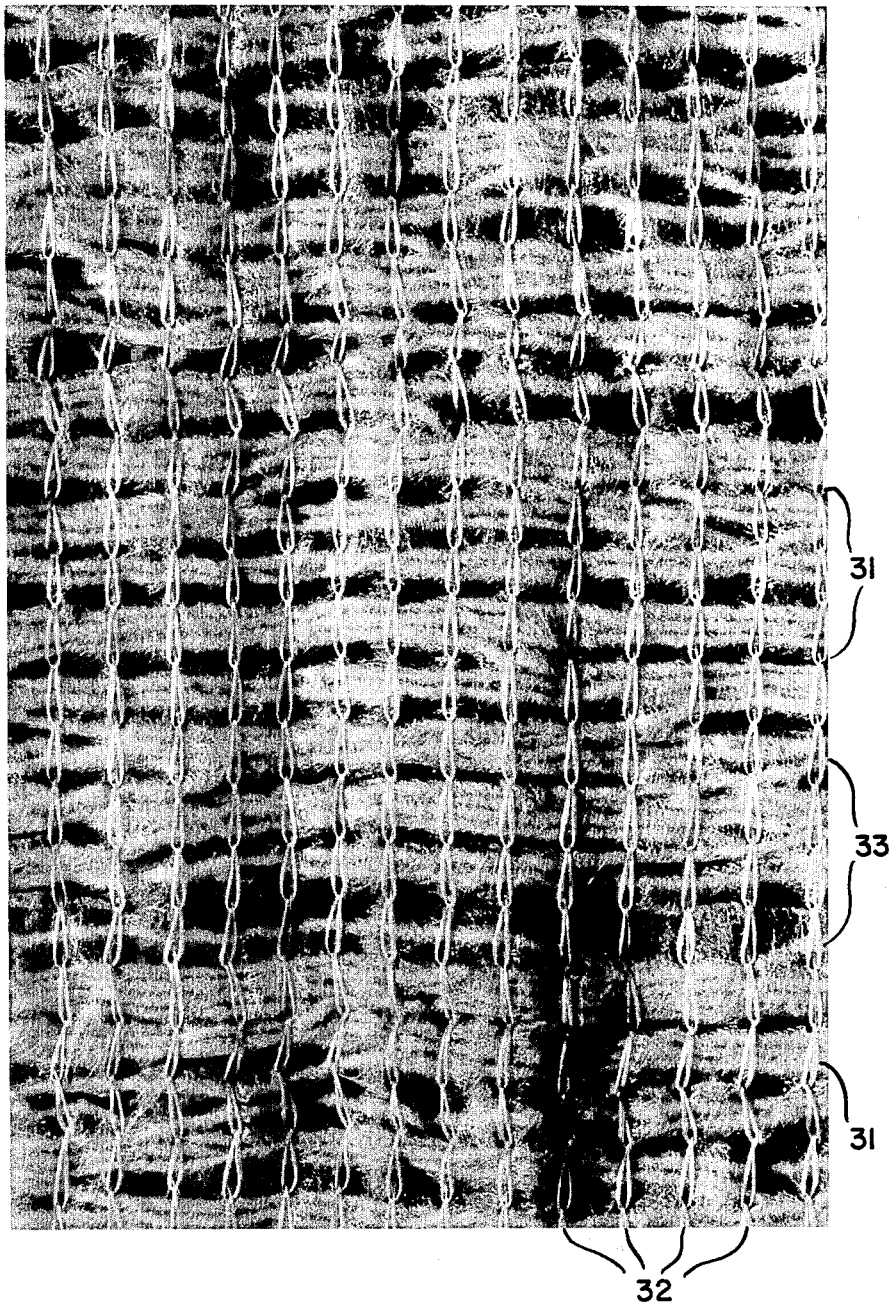
FIG. 4C is a plan view of the rear surface of the fabric of FIG. 4A.
Figure 4D:
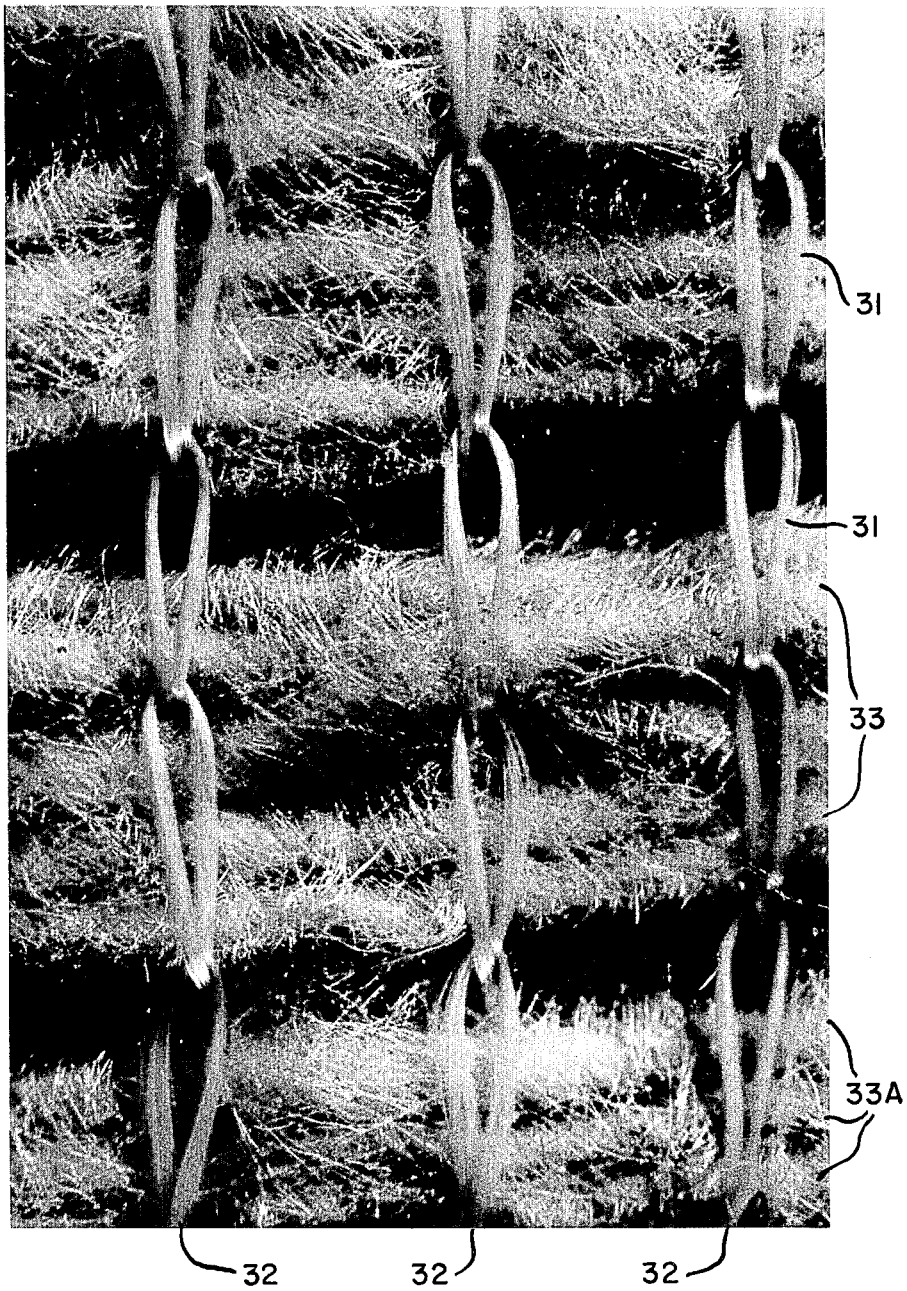
FIG. 4D is an enlarged view of the rear surface of a portion of the fabric of FIG. 4A.

As seen in FIG. 4C and in greater detail in FIG. 4D, the loops 31 of the knitting thread courses 32 on the rear side of the fabric of FIG. 4A bind the fibrous non-woven batting of the self liner (barely visible in the photographs) to the textile yarn filling elements 33 of the flexible substrate and to the warp elements (not shown).

Figure 5A:
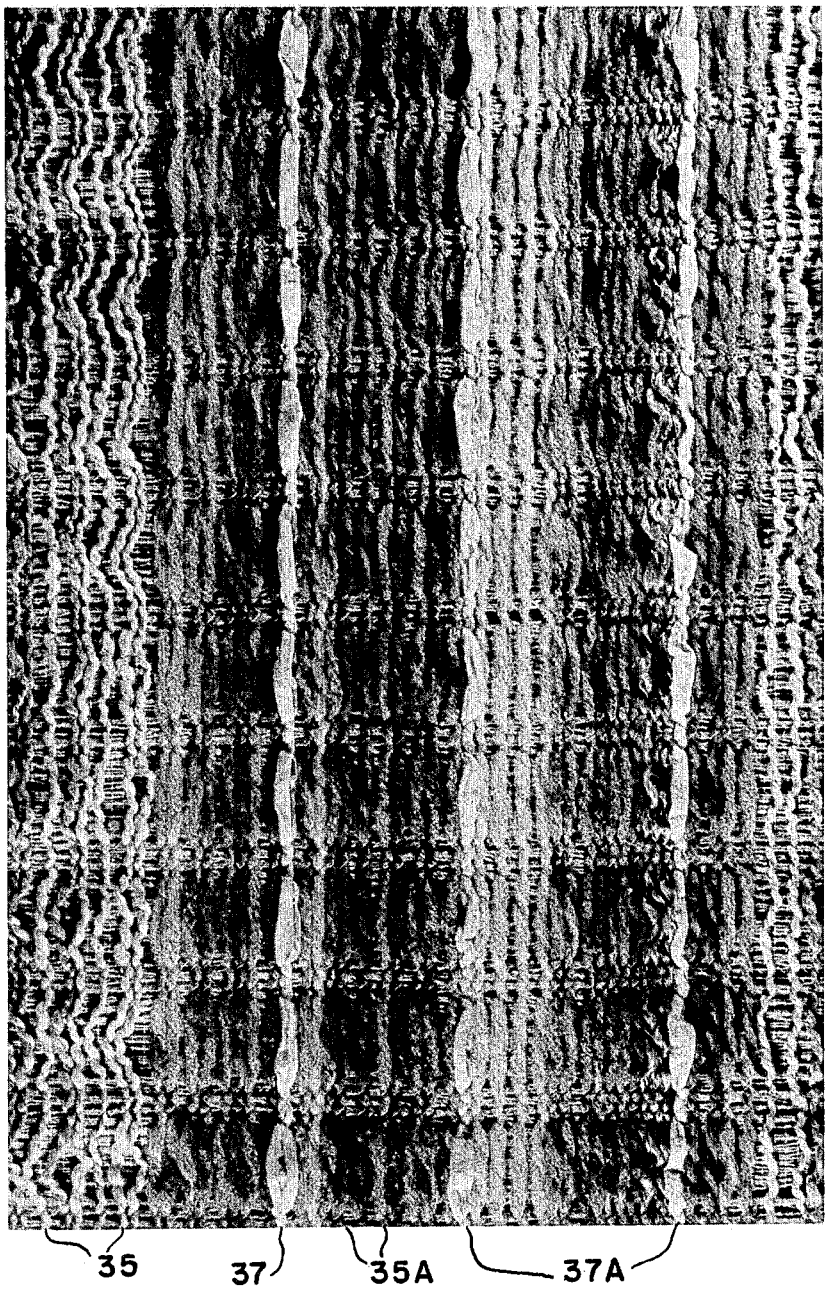
FIG. 5A is a plan view of the front surface of a third embodiment of the fabric of the invention.
Figure 5B:
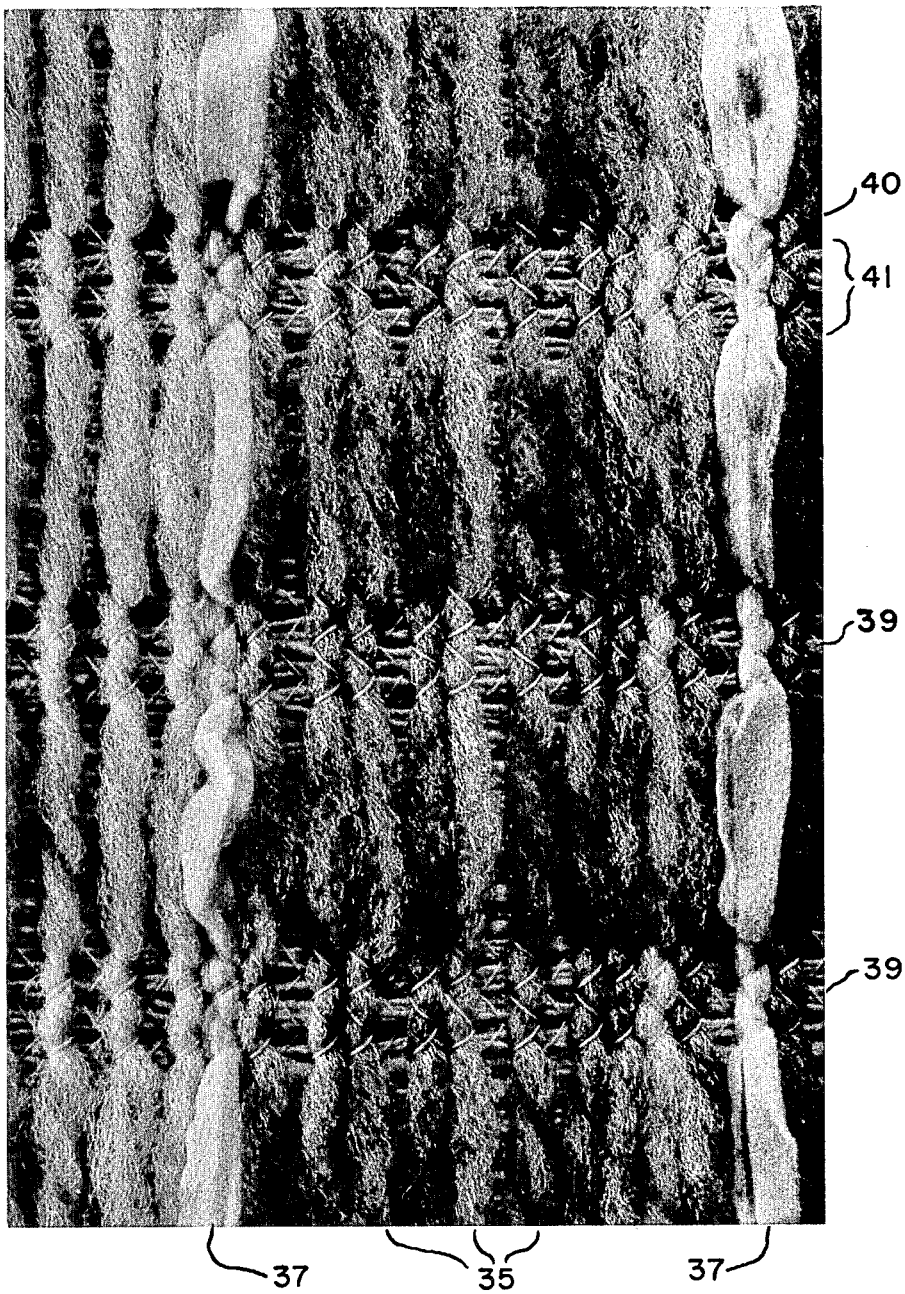
FIG. 5B is an enlarged front view of a portion of the fabric of FIG. 5A showing the relationship between the elements thereof.
Figure 5C:
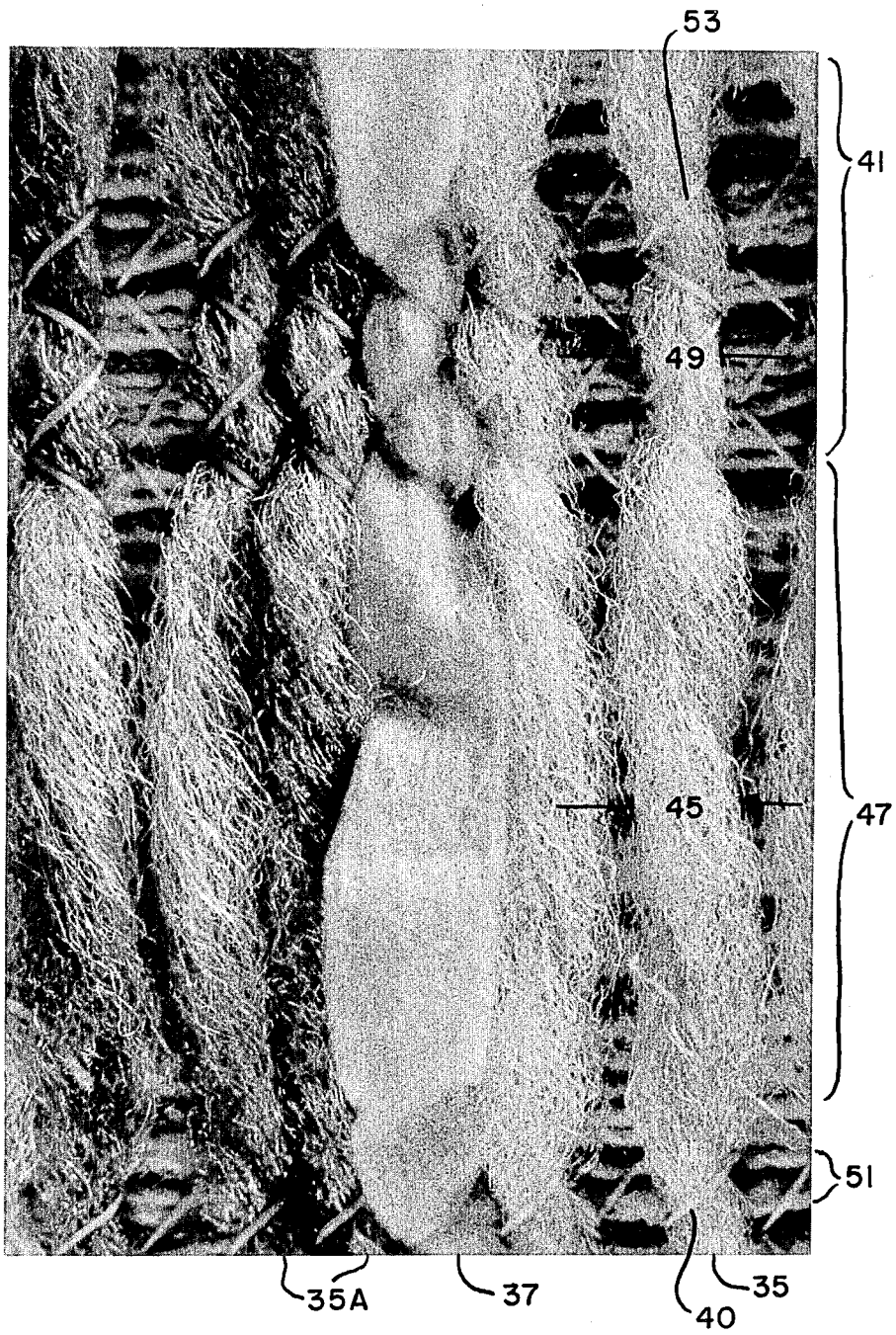
FIG. 5C is a further enlarged front view of a portion of the fabric of FIG. 5A showing the relationship between the elements thereof.
Figure 5D:
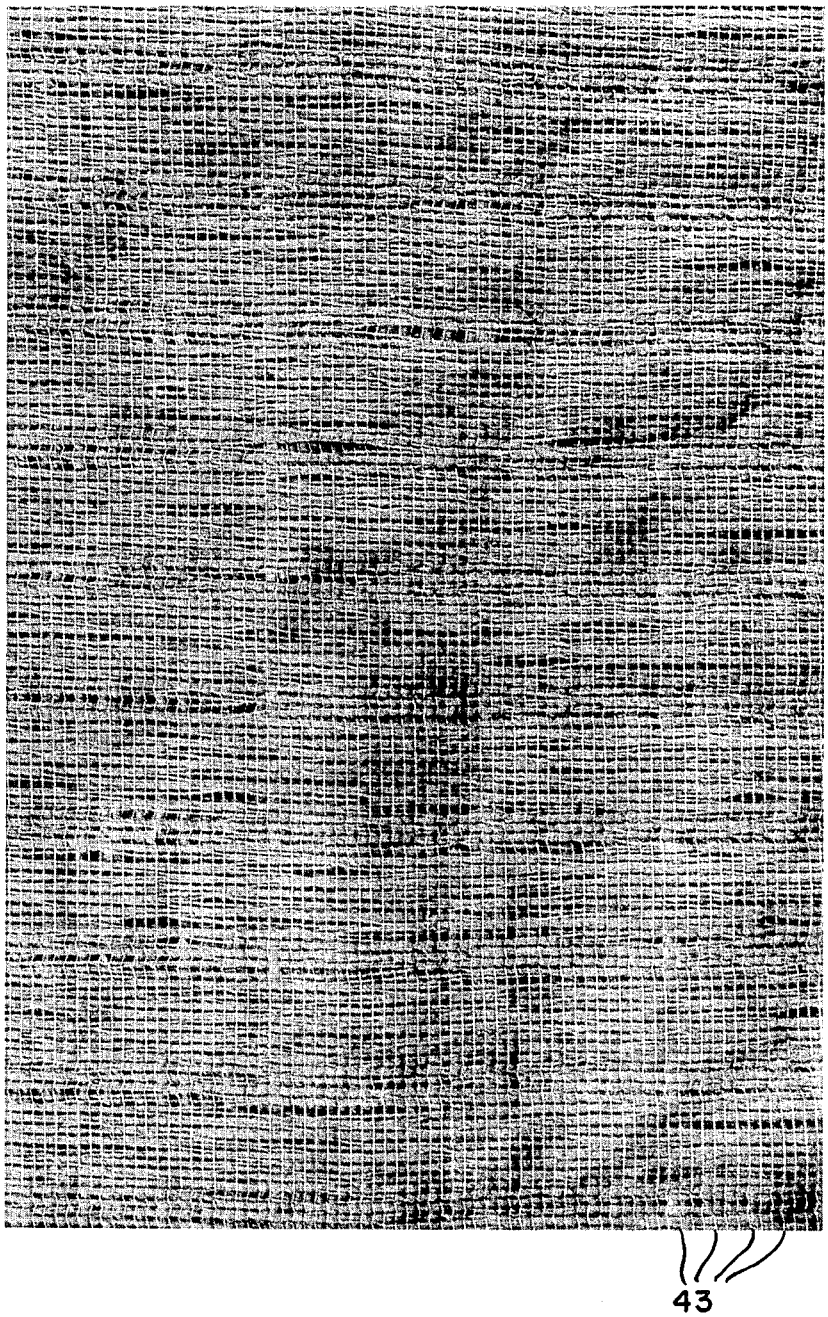
FIG. 5D is a plan view of the rear surface of the fabric of FIG. 5A.

Referring to FIG. 5A which is a plan view of a portion of the front surface of a third embodiment of the fabric construction of the invention, there are depicted warp elements 35 in the form of multifilament figure yarns in combination with warp elements 37 in the form of felt-like ribbons, both being joined, as shown in FIGS. 5B and 5C, to the textile filling yarns 39 of the flexible substrate by the diagonal laps 40 of the half-tricot stitch courses 41 of the 8-chain/4-half-tricot stitch knitting thread configuration, and, as shown in FIG. 5D, to the fibrous non-woven batting of the flexible self-liner by the loops of the knitting thread courses of the wales 43 on the rear surface of the fabric. FIG. 5C illustrates the dramatic effect of loft and bloom 45 of the warp elements 35 and 37 in the region 45 where these elements pass over and in non-secured relation to the chain stitch courses (not shown) of the knitting thread wales, as contrasted to the fettered appearance 49 of the warp elements where they are secured to the textile filling elements 51 by the diagonal laps 53 of the half-tricot stitch courses 41 of the knitting thread. FIG. 5A also demonstrates the decorative transverse band-like arrangement of the lofted warp element segments created by the alternating chain stitch and half-tricot segments of the knitting thread wales which is inherent in the use of a single needle guide bar as discussed above in connection with FIG. 2.

The foregoing examples are presented for the purpose of illustrating, without limitation, the novel single needle bar, warp lift-off resistant lofted fabric construction of the present invention. It is understood, of course, that changes and variations therein can be made without departing from the scope of the invention as defined in the following claims.

INDUSTRIAL APPLICABILITY

The present invention introduces a novel concept in decorative and functionally useful fabrics using a stitch-through type machine equipped with a single knitting thread guide bar for feeding the knitting thread to the work zone of the machine so that the other components of the fabric, i.e., the substrate and warp elements, are held together by the knitting thread in a warp lift-off-resistant configuration. In this way the warp elements are secured in such a way as to have increased resistance to running which otherwise could occur, particularly at the cut ends of the fabric. The fabric also has imparted to it a decorative lofted appearance in the warp elements which creates the illusion of depth and the appearance of a three-dimensional fabric structure.

Fabrics produced according to the present invention are useful in many decorative and functional applications, including draperies, tablecloths and bedspreads.

I claim:

1. A fabric made on a stitch-through type machine, comprising:

a flexible substrate;

a plurality of warp elements laid on the substrate in the general warpwise direction; and knitting thread wales extending in the warpwise direction and containing a multiplicity of warpwise stitches in a warp lift-off-resistant configuration network having, on a given knitting thread wale, a combination of chain stitch courses in securing relation to the substrate and generally non-securing relation to the warp elements, and half-tricot stitch courses in securing relation to both the substrate and warp elements, said knitting thread binding together into an integrated structure the substrate and warp elements, to secure the substrate and warp elements against relative displacement, and to stabilize the fabric against unravelling of the knitting thread network and lifting off of the warp elements, said fabric having an aesthetically pleasing appearance corresponding to the loft imparted to the warp elements by virtue of the generally non-securing relation of the chain stitch components of the knitting thread network to said warp elements.

2. The fabric according to claim 1 wherein the knitting thread warp lift-off-resistant configuration comprises, on a given knitting thread wale, at least one half-tricot stitch course followed by one or more consecutive chain stitch courses.

3. The fabric according to claim 2 wherein:

said fabric has from 3 to 22 knitting thread wales per linear inch in the weftwise direction; and each knitting thread wale has from 3 to 32 courses per linear inch in the warpwise direction.

4. The fabric according to claim 2 wherein:

said fabric has from 4 to 18 knitting thread wales per linear inch in the weftwise direction;

each knitting thread wale has from 6 to 16 courses per linear inch in the warpwise direction; and the knitting thread warp lift-off-resistant configuration comprises, on a given knitting thread wale, at least 3 consecutive chain stitch courses followed by one or more consecutive half-tricot stitch courses.

5. The fabric according to claim 2 wherein:

said fabric has from 7 to 10 knitting thread wales per linear inch in the weftwise direction;

each knitting thread wale has from 6 to 12 courses per linear inch in the warpwise direction; and the knitting thread warp lift-off-resistant configuration comprises, on a given knitting thread wale, at least 3 consecutive chain stitch courses followed by at least one half-tricot stitch course.

6. The fabric according to claim 1 wherein:

the flexible substrate comprises a layer of textile yarn filling elements; and the warp elements are yarns.

7. The fabric according to claim 1, 2, 3, 4, 5, or 6 wherein one or more warp elements in one position cross over on top of one or more adjacent warp elements and, in a second position, cross back under said one or more adjacent warp elements to provide a further aesthetically pleasing appearance corresponding to a twisted configuration of said warp elements at spaced intervals.

8. The fabric according to claim 1, 2, 3, 4, 5, or 6 wherein at least two warp elements are laid on the substrate along non-rectilinear paths in the warpwise direction, each warp element including portions of substantial length extending non-parallel to the warpwise direction.

9. The fabric according to claim 8 wherein one or more warp elements in one position cross over on top of one or more adjacent warp elements and, in a second position, cross back under said one or more adjacent warp elements for providing a further aesthetically pleasing appearance corresponding to a twisted configuration of warp elements at spaced intervals in combination with the non-rectilinear disposition of warp elements.

10. The fabric according to claim 1, 2, 3, 4, 5, or 6 comprising additionally a flexible lining material underlying the flexible substrate and warp elements such that the substrate is disposed between the lining and warp elements, and wherein the knitting thread engages and holds together the lining material, substrate and warp elements by loops of knitting thread courses on the rear surface of the fabric and by laps of knitting thread courses on the front surface of the fabric.

11. The fabric according to claim 10 wherein said fabric is further characterized in having a flexible backcoating of polymeric material.

12. The fabric according to claim 10 wherein one or more warp elements in one position cross over on top of one or more adjacent warp elements and, in a second position, cross back under said one or more adjacent warp elements to provide a further aesthetically pleasing appearance corresponding to a twisted configuration of said warp elements at spaced intervals.

13. The fabric according to claim 10 wherein at least two warp elements are laid on the substrate along non-rectilinear paths in the warpwise direction, each said warp element including portions of substantial length extending non-parallel to the warpwise direction.

14. The fabric according to claim 13 wherein one or more warp elements in one position cross over on top of one or more adjacent warp elements and, in a second position, cross back under said one or more adjacent warp elements for providing a further aesthetically pleasing appearance corresponding to a twisted configuration of warp elements at spaced intervals in combination with the non-rectilinear disposition of warp elements.

15. The fabric according to claim 1 wherein:

the flexible substrate comprises a layer of textile yarn filling elements; and the warp elements are ribbons.

* * * * *